US006693543B1

(12) United States Patent
Stephenson et al.

(10) Patent No.: US 6,693,543 B1
(45) Date of Patent: Feb. 17, 2004

(54) TAGGING DEVICE

(75) Inventors: Kenneth T. Stephenson, Middlesex (GB); Ian T. Dampney, Middlesex (GB)

(73) Assignee: Guidance Control Systems Limited, Leicester (GB)

( * ) Notice: Subject to any disclaimer, the term of this patent is extended or adjusted under 35 U.S.C. 154(b) by 0 days.

(21) Appl. No.: 09/959,673

(22) PCT Filed: May 4, 2000

(86) PCT No.: PCT/GB00/01543

§ 371 (c)(1),
(2), (4) Date: Mar. 11, 2002

(87) PCT Pub. No.: WO00/68920

PCT Pub. Date: Nov. 16, 2000

(30) Foreign Application Priority Data

May 5, 1999 (GB) ..... 9910224

(51) Int. Cl.[7] ..... G08B 13/14

(52) U.S. Cl. ..... 340/572.9; 340/573.4; 340/568.2; 340/572.8; 340/568.3; 340/568.4; 248/221.11; 248/220.22; 248/229.1

(58) Field of Search ..... 340/572.9, 573.1, 340/573.4, 542, 568.1, 568.2, 571, 572.1, 572.3, 572.8, 568.3, 568.4; 24/168, 175, 137, 182, 23 R, 171, 455; 248/221.11, 114, 220.22, 205.1, 205.2, 229.1

(56) References Cited

U.S. PATENT DOCUMENTS

| | | | | | |
|---|---|---|---|---|---|
| 4,736,196 | A | * | 4/1988 | McMahon et al. | 340/573.1 |
| 4,812,823 | A | * | 3/1989 | Dickerson | 340/572.8 |
| 4,851,815 | A | | 7/1989 | Enkelmann | |
| 4,885,571 | A | | 12/1989 | Pauley et al. | |
| 4,918,432 | A | | 4/1990 | Pauley et al. | |
| 4,924,211 | A | | 5/1990 | Davies | |
| 4,952,928 | A | | 8/1990 | Carroll et al. | |
| 4,962,369 | A | | 10/1990 | Close | |
| 5,032,823 | A | | 7/1991 | Bower et al. | |
| 5,103,474 | A | | 4/1992 | Stoodley et al. | |
| 5,146,207 | A | | 9/1992 | Henry et al. | |
| 5,189,395 | A | | 2/1993 | Mitchell | |
| 5,189,763 | A | * | 3/1993 | Voumard | 24/175 |
| 5,266,944 | A | | 11/1993 | Carroll et al. | |
| 5,298,884 | A | | 3/1994 | Gilmore et al. | |
| 5,396,227 | A | | 3/1995 | Carroll et al. | |
| 5,504,474 | A | * | 4/1996 | Libman | 340/572.8 |
| 5,512,879 | A | | 4/1996 | Stokes | |
| 5,627,520 | A | * | 5/1997 | Grubbs et al. | 340/572.8 |
| 5,831,535 | A | * | 11/1998 | Reisman et al. | 340/573.1 |
| 6,104,295 | A | * | 8/2000 | Gaisser et al. | 340/573.4 |

FOREIGN PATENT DOCUMENTS

| | | |
|---|---|---|
| GB | 2 218 245 A | 11/1989 |
| GB | 2 242 399 A | 10/1991 |
| GB | 2 279 170 A | 12/1994 |
| WO | PCT/GB90/00321 | 9/1990 |

* cited by examiner

*Primary Examiner*—Jeffery Hofsass
*Assistant Examiner*—Daniel Prekil
(74) *Attorney, Agent, or Firm*—Dickstein Shapiro Morin & Oshinsky LLP

(57) ABSTRACT

A tagging device comprises a strap attached to a housing. A latch plate is mounted on a first length of strap and a collar is slidably mounted on a second length of strap. The latch plate has two location pegs which fit into holes on the first length of strap such that a hole fits over the lug to make the strap the correct size for a user. Two flexible barbs are formed on the collar such that the collar slides over the plate and the barbs are deformed as they slide up slopes on the plate. As the barbs slide off the end of the slopes they return to their rest position and snap into slots. Moving the collar in relation to the plate once the barbs have snapped into place in the slots causes the barbs to break, giving an indication of tampering.

27 Claims, 7 Drawing Sheets

TAGGING DEVICE

The invention relates to the tagging of objects in order to confirm or detect their presence in a predefined space at a predefined time. The invention further relates to straps for devices for which any attempt at tampering needs to be reported automatically and to fastening means for such straps.

SUMMARY OF THE INVENTION

The tagging of objects in order to confirm or detect their presence in a predefined space at a predefined time is desirable in certain situations. The electronic tagging of offenders is known and is being used more often. In particular, with increasing overcrowding of prisons and other offender institutions, many authorities are beginning to use electronic tagging to allow early release or house arrest of certain offenders. Electronic tagging may also be used to monitor of the presence of a person in a particular area. This may be particularly useful to monitor patients in a hospital or other institution and may also be used for people working in a secure environment such as a nuclear power plant or a military establishment.

Electronic monitoring devices may be used to monitor the presence of a person or animal, for example racehorses or pedigree dogs, or may be used to monitor the presence of an object such as laptop computers or other expensive items.

An electronic tag or monitoring device, often referred to as a personnel monitoring device when used on people, usually includes a circuit board with a radio transmitter and batteries in a housing and a flexible strap that is fastened around the writs or ankle of the person. The device may only be removed by breaking the fastening, cutting the strap or breaking open the housing. The device includes a number of tamper detection features such as a flexible printed circuit board within the strap that forms a complete circuit when the strap is fastened on the person and proximity sensors to indicate if the device is in proximity to the body of the user. A signal is sent from the radio transmitter to a monitoring unit in, for example, the person's home. This may be connected to a normal phone line and if the person leaves the vicinity of the monitoring unit or if there is any tampering with the tagging device, the information is transmitted to a central unit or service provider and a follow-up investigation can be carried out. A tamper signal will be sent if the strap is cut and the circuit is broken or if the housing is tampered with. Proximity sensors on the flexible printed circuit board will send a tamper signal if the strap is removed from the person's limb or if adjacent parts of the strap are separated.

The device needs to fit closely but comfortably on the user. In particular, it needs to be fastened on securely so that it cannot be removed without alerting the monitoring unit and without showing visible signs of tampering. Present types of tagging device have a strap that is fastened together by rivets or screws or similar fastening devices that need tools to fix them. Snap together closures that form a permanent lock on a strap are also known. All these types of fastenings form a permanent closure such that the strap has to be cut to remove the device from the user.

A particular disadvantage of presently used devices is the need to use tools to fasten the strap. This means that straps take some time to fit and the fitter is required to have additional equipment as well as expertise in fitting the devices. A further disadvantage of presently used devices is the lack of reusability of the device once the strap has been cut. The batteries that are commonly used in electronic tagging devices may have a usable life of about 8 months but typically these devices are used for a much shorter period on any one person. Thus, it would be advantageous to have a tagging device that could be easily used for more than one person.

SUMMARY OF THE INVENTION

It is an object of the invention to provide a tagging device having a strap with a fastening means that is simple and easy to close, that shows evidence of any tampering but that enables the strap to be reused. Further objects of the invention include providing such a strap that can easily be adjusted to fit a variety of sizes and providing a tamper-evident fastening for such a strap.

The invention provides a fastening means for a strap for a tagging device in accordance with various of the appended claims. The invention further provides a combination of a strap and a fastening means for a tagging device in accordance with various other of the appended claims. The invention further provides a tagging device in accordance with yet other of the appended claims.

The strap may be integrally moulded with the housing or may be attached by suitable means such as welding. Once the electronic circuitry is in place within the housing, the housing is advantageously sealed closed. Preferably the housing further includes battery means.

Preferably the electrical circuit means included in the strap comprises a flexible printed circuit board integrally moulded within the strap.

Preferably the latch plate contacts the electrical circuit means within the strap to close a circuit around the device with the fastening means is closed.

Preferably the engagement means on one of the collar or the latch plate comprises breakable elements that engage with receiving means in the form of slots on the other of the collar or the latch plate such that the elements snap when the collar is retracted from the latch plate.

Preferably the breakable elements comprise barbs on the inside of the collar which deform to snap over ridges in corresponding receiving slots on the latch plate. These barbs are preferably strong enough to hold the collar in position on the latch plate so that it is not inadvertently disengaged but weak enough to break if the collar is forcibly removed from the latch plate. Once the barbs are broken there is visible evidence that the user has attempted to tamper with the device, even if the collar is fitted back over the latch plate without the device being removed from the user.

The collar and latch plate of the fastening means provide a "single use", tamper-evident fastening that is visibly damaged once it is opened. However, the strap is not damaged when the fastening means is opened and the device can easily be reused by replacing just the damaged part of the fastening means, conveniently the collar. In this way, a new collar is simply slipped onto the second free end of the strap, ready for the device to be fastened onto another user.

Preferably the retaining means on the latch plate comprises a lug and the retaining means on the second free end of the strap comprises at least one corresponding hole such that the lug fits into the hole to hold the first and second free ends of the strap in a fixed relative position when the fastening means is engaged.

Advantageously the device further includes means to adjust the length of the strap to suit a wide variety of user sizes. Preferably the adjustment means comprises a plurality of holes on the second free end of the strap to correspond to the lug on the latch plate such that the lug engages with a hole at a position to provide a desired size of closed strap. When the strap is fitted on a user, the second free end of the strap is adjusted to a suitable position to give a snug fit of the device on the user and the lug on the latch plate on the first free end of the strap fits into an adjacent hole on the second free end of the strap. The collar is then moved into engagement over the latch plate and holds the strap in position.

The device can be made with straps in a plurality of sizes to suit different sizes of objects but it has been found for human users that the length adjustment means enables the number of sizes required to fit the majority of the population can be reduced, advantageously to two sizes, small and large. This has the commercial advantage of enabling all users to be provided for with the supply of only two sizes, if desired.

The latch plate further comprises a connecting protrusion and the electrical circuit means in the first end of the strap includes a switch means such that when the collar is fitted over the latch plate the connecting protrusion is moved to create a contact in the switch means and when the collar is removed from the latch plate the protrusion moves to release the contact in the switch means. The movement of the protrusion over the switch means closes the electrical circuit in the strap. Advantageously the electrical circuit means further includes proximity sensors to sense if the device is adjacent the body of a user or, additionally or alternatively, to sense whether the two ends of the strap are in proximity to one another.

The latch plate may be integrally formed with the first free end of the strap or may be a separate element. If the latch plate is a separate element, it advantageously comprises at least one lug for engagement with a corresponding hole in the first free end of the strap.

The latch plate may alternatively comprise two plates for attaching on either side of the strap. The two plates preferably comprise a top plate and an actuator plate. Advantageously the actuator plate is inserted through the strap at the required position. The actuator plate and the top plate preferably comprise corresponding mating means and the top plate is positioned on the actuator plate such that the mating means engage and hold the two plates together through the strap. Advantageously the actuator plate comprises a switch actuator pin which passes through the strap to create a contact with the switch means when the collar is positioned over the assembled top plate and actuator plate.

If the tagging device is removed from the user, a remote monitoring device may be activated to provide an alert signal. Advantageously the latch plate is arranged such that moving the collar causes the contact to be broken and the alarm to be activated, even if the user attempts to hold the latch plate in position on the strap.

The device monitors its own state and determines whether there has been an attempt at tampering. If an attempt at tampering is detected, the device can communicate that to a central site, for example via a telephone link or radio signal. Preferably the electronic circuitry within the housing includes means for transmitting a signal to a location remote from the device.

BRIEF DESCRIPTION OF THE DRAWINGS

The invention will now be described, by way of example only, by reference to the accompanying drawings, of which.

DETAILED DESCRIPTION OF PREFERRED EMBODIMENTS

Figure 1:
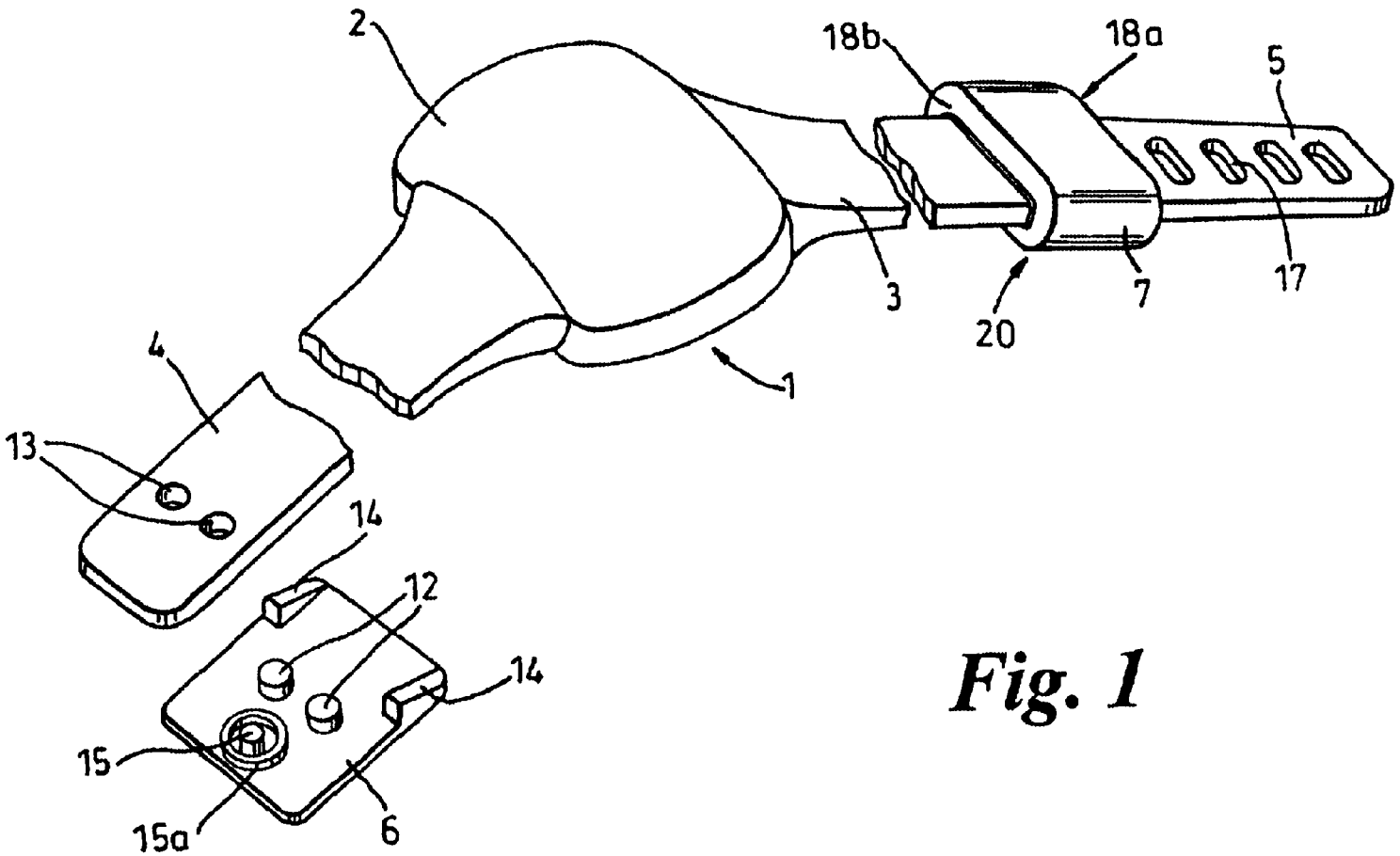
FIG. 1 shows a perspective view of a tagging device in accordance with one aspect of the invention.

As shown in FIG. 1, a tagging device 1 according to one aspect of the invention comprises a housing 2 in which are sealed a radio transmitter and batteries (not shown). A strap 3 is attached to the housing 2 by suitable means. It may be integrally moulded, welded, glued or otherwise fixed depending on the materials used and the requirements of the device. The strap 3 comprises a first free end 4, which forms a first length of strap, and a second free end 5, which forms a second length of strap.

A latch plate 6 is mounted on the end of the first length of strap 4 and a collar 7 is slidably mounted on the end of the second length of strap 5.

Figure 2:
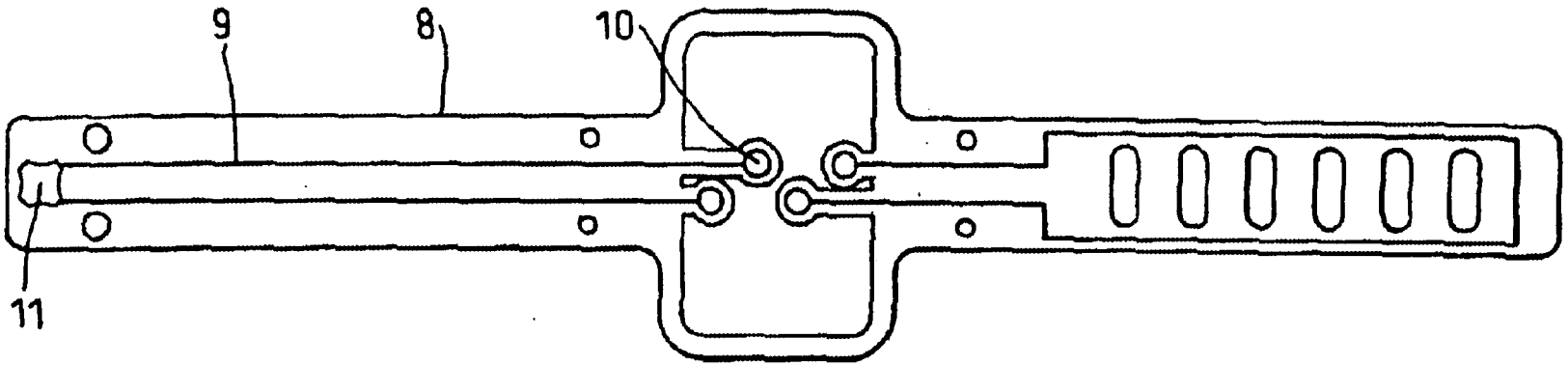
FIG. 2 shows a plan view of a printed circuit that is moulded within the strap of the device of FIG. 1.

A flexible printed circuit board 8 is moulded within the strap 3. The printed circuit board 8 is enclosed within the strap 3 and the housing 2 and is shown separately in FIG. 2. An electrical circuit is formed by tracks 9 which are connected via terminals 10 to a battery (not shown) within the housing 2. The circuit includes a switch 11 at the end of the first length of strap 4.

Referring again to FIG. 1, the latch plate 6 has two location pegs 12 which fit into holes 13 on the first length of strap 4 to hold the plate 6 in position relative to the strap 3. Wings 14 are formed in the sides of the plate 6 to prevent sideways movement of the plate 6 relative to the strap 3 and also to inhibit access to the interior of the collar 7 when the strap 3 is locked closed.

A connecting protrusion in the form of an activator pin 15 is formed on the plate 6 which acts to press on strap 4 and close the switch 11 when the strap 3 is locked. A wall 15 is formed around the pin 15 to prevent access to the pin 15 and switch 11.

Figure 3:
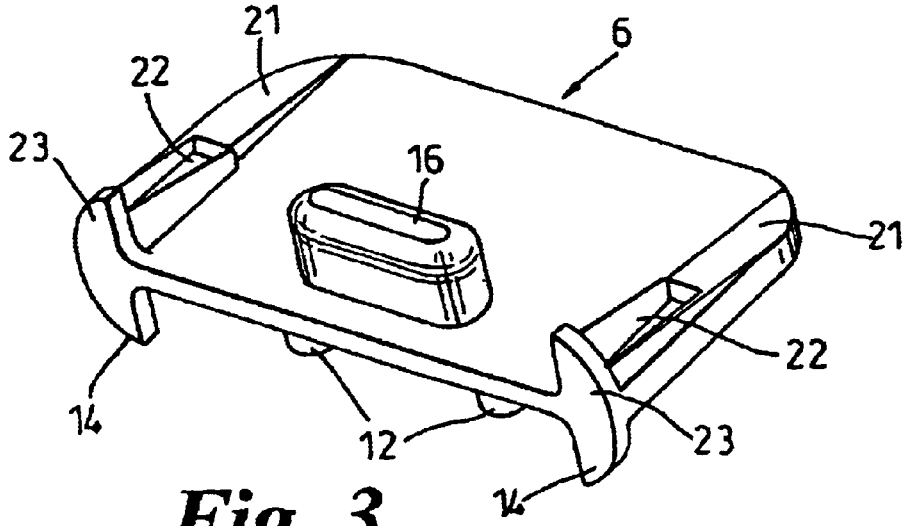
FIG. 3 shows the latch plate of the device as shown in FIG. 1 in perspective showing the other face.

Referring now to FIG. 3 as well, the reverse side of the plate 6 is shown, on which a protruding lug 16 is formed. Holes 17 on the second length of strap 5 correspond to the lug 16 such that when the strap 3 is positioned on a user the appropriate hole 17 fits over the lug 16 to make the strap 3 the correct size for the user.

Figure 4:
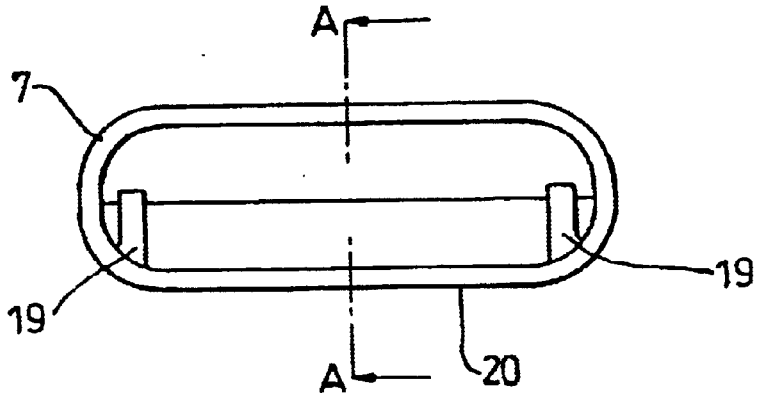
FIG. 4 shows the collar of the device of FIG. 1 in end view.
Figure 5:
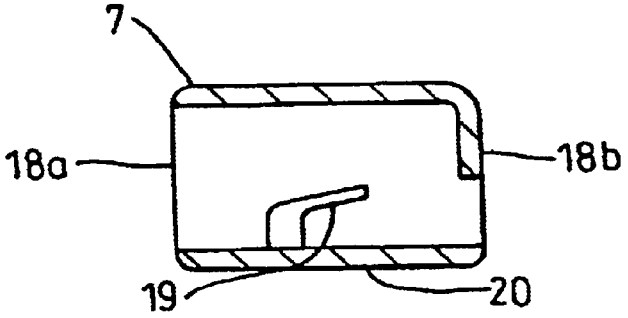
FIG. 5 shows the collar as shown in FIG. 4 in cross-section along the line A—A.

Referring now to FIGS. 4 and 5 as well, the collar 7 encircles the strap 3 on the second length of the strap 5 such that it can be moved along the strap 5. The front face 18*a* of the collar 7 is open to allow the collar 7 to fit over the latch plate 6 and the rear face 18*b* is formed to fit closely over the strap 5 to prevent access to the interior of the collar 7 when it is fastened in the locked position.

Two barbs 19 are formed on the inner surface of the collar 7. The barbs 19 are flexible and can be deformed towards the lower surface 20 of the collar 7. When the strap 3 is assembled on a user, the collar 7 slides over the plate 6 and the barbs 19 are deformed as they slide up slopes 21 on the plate 6. As the barbs 19 slide off the end of the slopes 21 they deform back to their rest position and thus snap into slots 22. Wings 23 on the plate 6 prevent access to the interior of the collar 7. Removal of the collar 7 from the plate 6 once the barbs 19 have snapped into place in the slots 22 causes the barbs 19 to break, giving an indication that the collar 7 has been tampered with.

Figure 6A:
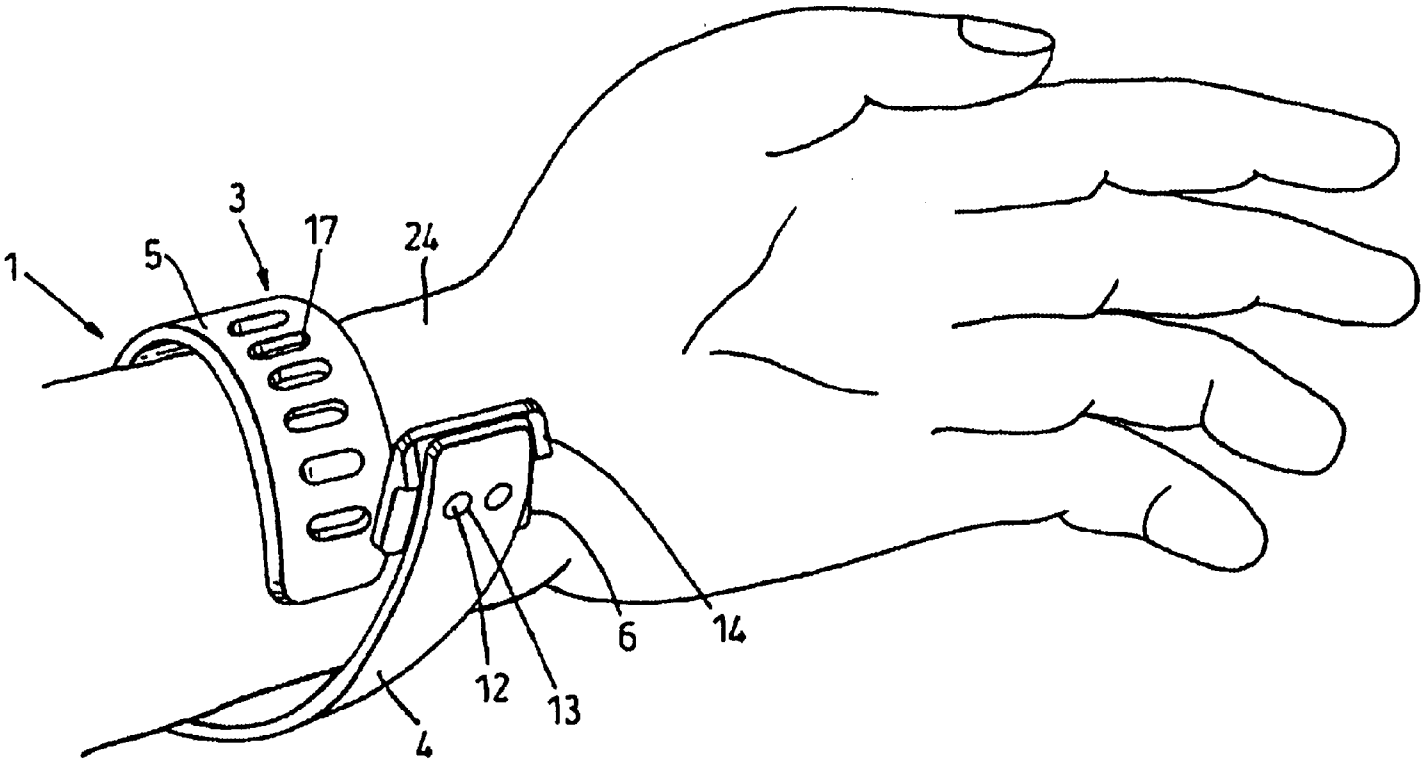
FIGS. 6*a* and 6*b* show perspective views of the device of FIG. 1 being attached to the wrist of a user.
Figure 6B:
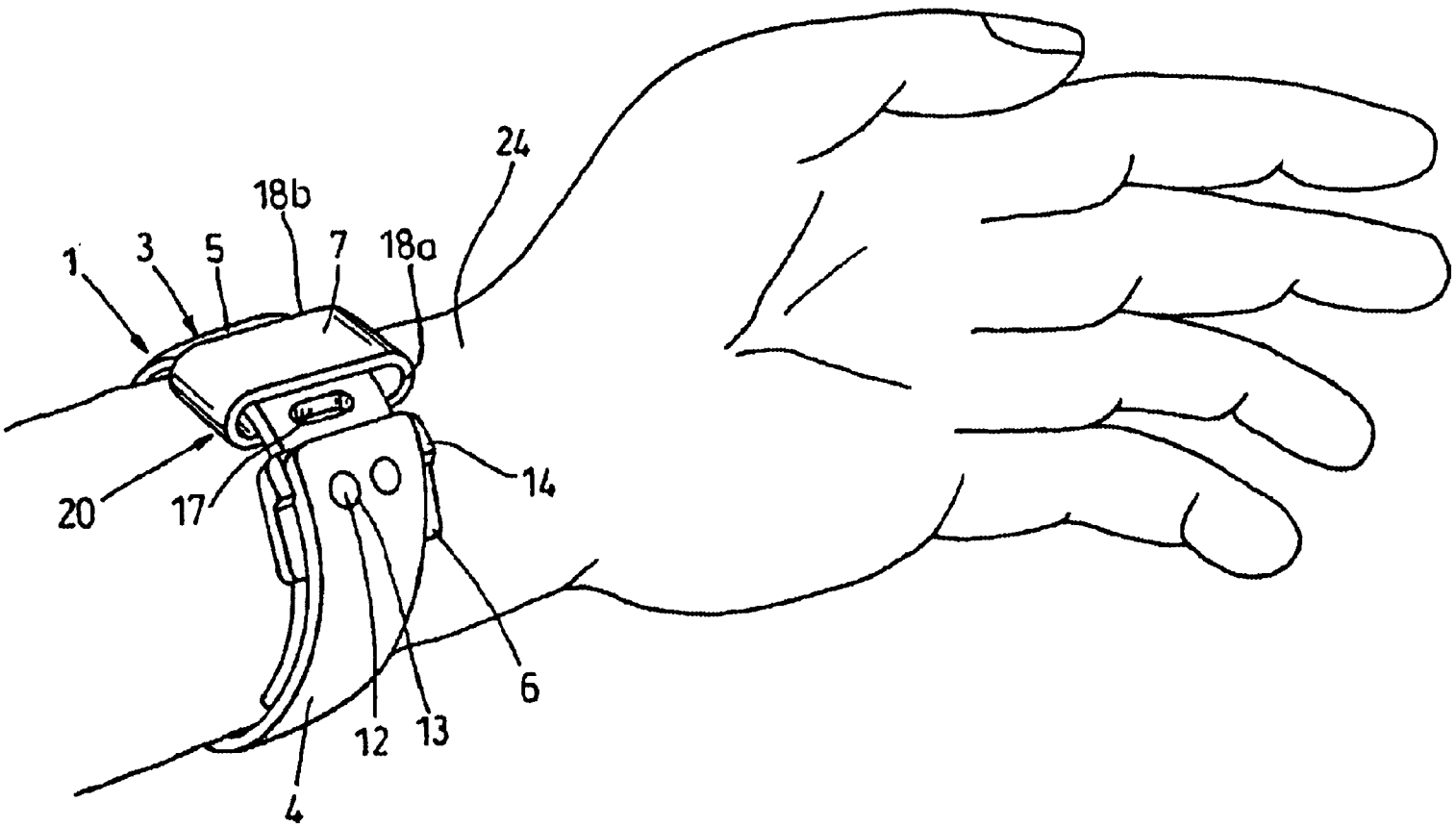

FIGS. 6*a* and 6*b* show a tagging device 1 according to one aspect of the invention being fastened on the wrist 24 of a user. In FIG. 6*a,* the strap 3 is adjusted to a comfortable but snug fit on the wrist 24 by positioning the lug 16 (not visible) in one of the holes 17 on the second length of strap 5. The latch plate 6 is held in position on the first length of strap 4 by the location of the pegs 12 in the holes 13 and the free end of the second length of strap 5 lies between the wings 23 on the plate 6 and inside the other length of strap 4.

Figure 7A:
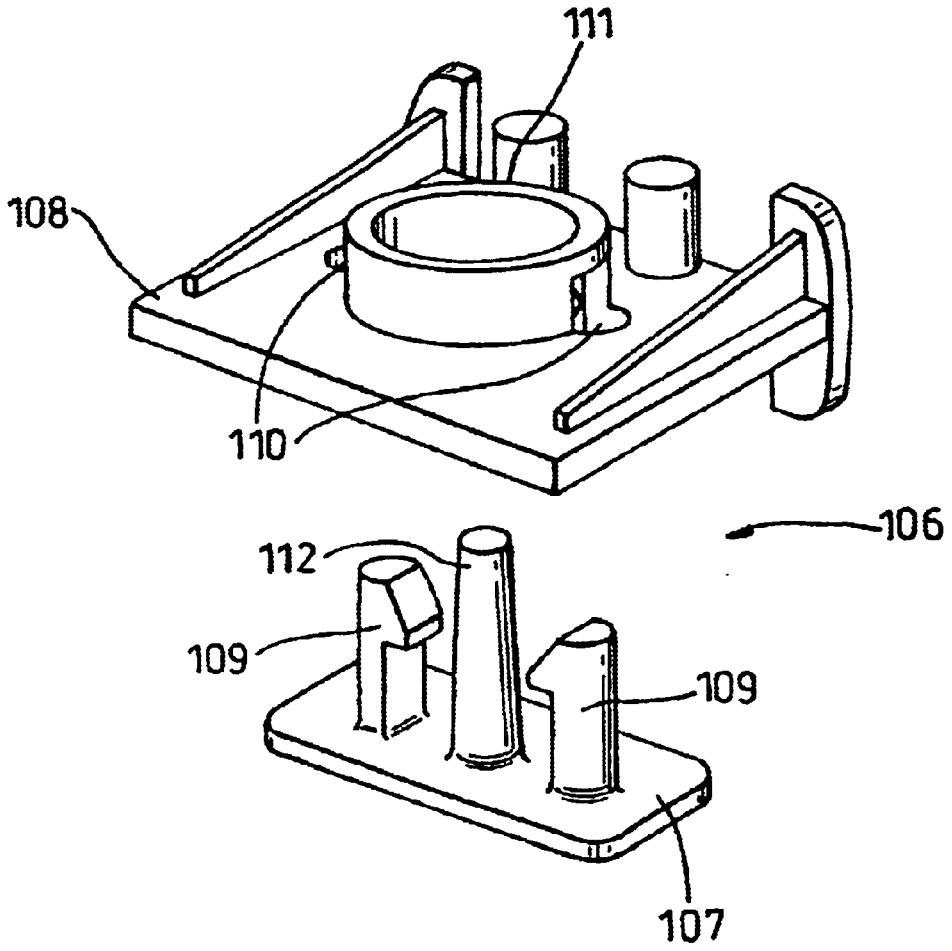
FIGS. 7*a*, 7*b* and 7*c* show an alternative latch plate of the device.
Figure 7B:
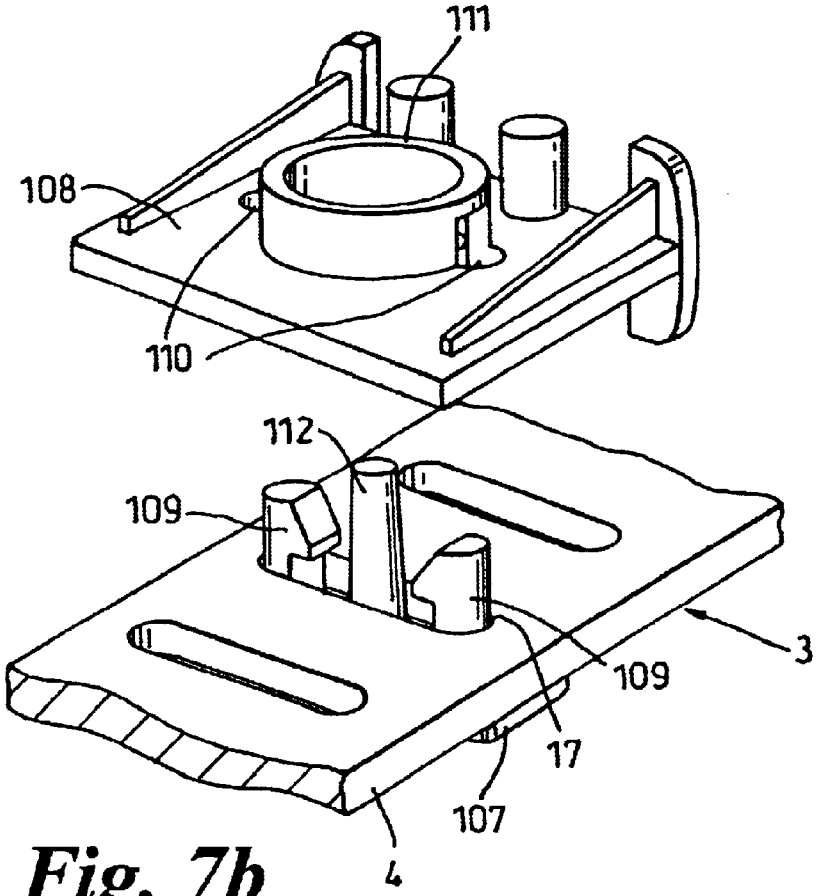
Figure 7C:
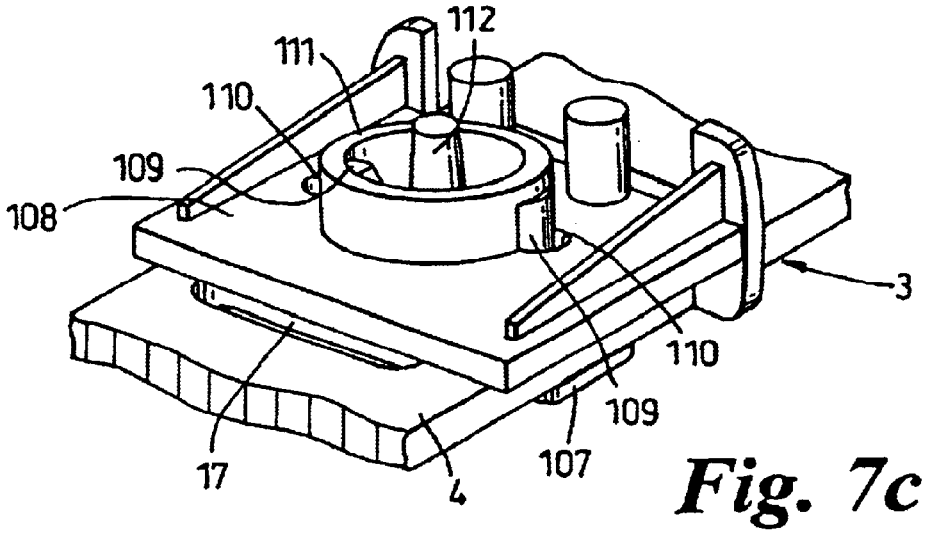

FIGS. 7*a,b* and *c* show an alternative latch plate 106 of the device 1. The latch plate 106 comprises an actuator plate 107 and a top plate 108. The actuator plate 107 has retention clips 109 that co-operate with recesses 110 in an annulus 111 formed on the top plate 108. The retention clips 109 are passed through a hole 17 in the first length of strap 4 and the top plate 108 is then pressed onto the actuator plate 106 such that the retention clips 109 mate with the recesses 110 in the annulus 111. This locks the actuator plate 107 and the top plate 108 to the strap 3 to form the latch plate 106. A switch actuator pin 112 is formed on the actuator plate 107 and passes through the hole 17 in the strap 3 and the centre of the annulus 111. Further assembly of the device is the same as described with reference to FIGS. 1 to 6.

The strap 3 is moulded from plastics material and may be contoured to allow airflow around the strap 3 and thus increase the comfort for the user.

When the strap 3 is adjusted to the desired position, the collar 7 is slid along the strap 5 and over the plate 6 until the barbs 19 inside the collar 7 snap into position in the slots 22 and the collar 7 is then held in the locked position. When the collar 7 is in the locked position the activator pin 15 presses on the switch 11 and completes the circuit around the tracks 9 within the printed circuit board 8. If the circuit is subsequently broken, for example by cutting the strap 3; a signal is sent to a monitoring unit (not shown) to indicate tampering with the strap 3.

If the collar 7 is moved in relation to the plate 6, the barbs 19 are snapped off. This provides a visible indication of tampering with the device 1. Additionally, as the collar 7 is retracted, the pressure on the activator pin 15 is released and the pin 15 no longer activates the switch 11. This breaks the circuit in the printed circuit board 8 and a signal is sent to a monitoring unit (not shown) to indicate tampering, similarly to if the strap 3 is cut.

Once the user is no longer required to wear the tagging device 1, it is simple to remove. The collar 7 is slid off the plate 6, breaking the barbs 19, and the device 1 is removed. To reuse the tagging device 1, a new collar 7 is simply replaced on the second length of strap 5 and the device 1 is ready for reuse, with no need to replace any of the other parts.

The device of the invention is simple to use and provides a device that is easily adjustable to a wide range of sizes. The device has a simple locking system that is clearly tamper-evident. The device is particularly useful for "house arrest" situations and electronic tagging of offenders but will also be useful for monitoring the presence of people, animals and objects in a wide variety of situations. The device can also be used to give an indication of the entry of a person or object into a restricted area.

What is claimed is:

1. A strap and fastening means for a tagging device comprising:

a strap including electrical circuit means, the strap having a first free end and a second free end; and fastening means to lock the strap on an object, wherein the fastening means comprises:

a latch plate on the first free end of the strap, the latch plate and the second end of the strap comprising corresponding retaining means such that the retaining means on the latch plate engages with the retaining means on the second free end of the strap to maintain the two ends of the strap in a fixed relative position when the fastening means is engaged and wherein the latch plate comprises a top plate and an actuator plate, the actuator plate having one or more lugs that engage with a hole from one side of the strap and the actuator plate and the top plate having corresponding mating means such that the top plate engages with the actuator plate from the other side of the strap and through the hole; and a collar on the second free end of the strap, the collar being movable to a closed position on the latch plate to hold the two ends of the strap together when the retaining means on the latch plate and the second free end of the strap are in the engaged position, one of the collar and the latch plate further including engagement means and the other of the collar and the latch plate further including corresponding receiving means such that the engagement means engage with the receiving means when the collar is in the closed position and such that one of the engagement means and receiving means shows evidence of tampering if the collar has been disengaged from the latch plate;

and wherein the latch plate further comprises a connecting protrusion and the electrical circuit means in the first end of the strap includes a switch means such that when the collar is fitted over the latch plate the connecting protrusion is to create a contact in the switch means and when the collar is moved in relation to the latch plate the protrusion moves to release the contact in the switch means.

2. A strap and fastening means for a tagging device according to claim 1 wherein the electrical circuit means comprises a flexible printed circuit board integrally moulded within the strap.

3. A strap and fastening means for a tagging device according to claim 1 wherein the latch plate contacts the electrical circuit means within the strap to close a circuit around the device when the fastening means is closed.

4. A strap and fastening means for a tagging device according to claim 1 wherein the engagement means on one of the collar or the latch plate comprises breakable elements that engage with receiving means in the form of slots on the other of the collar or the latch plate such that the elements snap when the collar is moved in relation to the latch plate.

5. A strap and fastening means for a tagging device according to claim 4 wherein the breakable elements comprise barbs on the inside of the collar which deform to snap over ridges in corresponding receiving slots on the latch plate.

6. A strap and fastening means for a tagging device according to claim 5 wherein the barbs are strong enough to hold the collar in position on the latch plate so that it is not inadvertently disengaged but are weak enough to break if the collar is forcibly moved in relation to the latch plate.

7. A strap and fastening means for a tagging device according to claim 1 wherein the retaining means on the latch plate comprises a lug and the retaining means on the second free end of the strap comprises at least one corresponding hole such that the lug fits into the hole to hold the first and second free ends of the strap in a fixed relative position when the fastening means is engaged.

8. A strap and fastening means for a tagging device according to claim 1 wherein the device further includes means to adjust the length of the strap to suit a wide variety of user sizes.

9. A strap and fastening means for a tagging device according to claim 8 wherein the adjustment means comprises a plurality of holes on the second free end of the strap to correspond to a lug on the latch plate such that the lug engages with a hole at a position to provide a desired size of closed strap.

10. A strap and fastening means for a tagging device according to claim 1 wherein the connecting protrusion comprises a switch actuator pin on the actuator plate, the switch actuator pin passing through the hole in the strap and through a corresponding hole in the top plate for contact with the switch means.

11. A strap and fastening means for a tagging device according to claim 10 wherein the movement of the protrusion over the switch means closes the electrical circuit in the strap.

12. A strap and fastening means for a tagging device according to claim 1 wherein the latch plate is arranged such that moving the collar causes the contact to be broken and an alarm to be activated.

13. A fastening means for a strap for a tagging device comprising:

a latch plate for positioning on a first free end of a strap, the latch plate comprising retaining means for engagement with retaining means on a second free end of the strap to maintain the two ends of the strap in a fixed relative position when the fastening means is engaged, and the latch plate contacts electrical circuit means within the strap to close a circuit when the fastening means is closed; and a collar for positioning on the second free end of the strap, the collar being movable to a closed position on the latch plate to hold the two ends of the strap together when the retaining means on the latch plate and the second free end of the strap are in the engaged position, one of the collar and the latch plate further including engagement means and the other of the collar and the latch plate further including corresponding receiving means such that the engagement means engage with the receiving means when the collar is in the closed position and such that one of the engagement means and receiving means shows evidence of tampering if the collar has been disengaged from the latch plate; and wherein the latch plate further comprises a connecting protrusion and the electrical circuit means in the first end of the strap includes a switch means such that when the collar is fitted over the latch plate the connecting protrusion is moved to create a contact in the switch means and when the collar is moved in relation to the latch plate the protrusion moves to release the contact in the switch means.

14. A fastening means for a strap for a tagging device according to claim 13, wherein the engagement means on one of the collar or the latch plate comprises breakable elements that engage with receiving means in the form of slots on the other of the collar or the latch plate such that the elements snap when the collar is moved in relation to the latch plate.

15. A fastening means for a strap for a tagging device according to claim 14, wherein the breakable elements comprise barbs on the inside of the collar which deform to snap over ridges in corresponding receiving slots on the latch plate.

16. A fastening means for a strap for a tagging device according to claim 15, wherein the barbs are strong enough to hold the collar in position on the latch plate so that it is not inadvertently disengaged but are weak enough to break if the collar is forcibly moved in relation to the latch plate.

17. A fastening means for a strap for a tagging device according to claim 13, wherein the retaining means on the latch plate comprises a lug and the retaining means on the second free end of the strap comprises at least one corresponding hole such that the lug fits into the hole to hold the first and second free ends of the strap in a fixed relative position when the fastening means is engaged.

18. A fastening means for a strap for a tagging device according to claim 17, wherein the latch plate comprises a top plate and an actuator plate, the actuator plate having one or more lugs that engage with a hole from one side of the strap and the actuator plate and the top plate having corresponding mating means such that the top plate engages with the actuator plate from the other side of the strap and through the hole.

19. A fastening means for a strap for a tagging device according to claim 18, wherein the connecting protrusion comprises a switch actuator pin on the actuator plate, the switch actuator pin passing through the hole in the strap and through a corresponding hole in the top plate for contact with the switch means.

20. A fastening means for a strap for a tagging device according to claim 19, wherein the movement of the protrusion over the switch means closes the electrical circuit in the strap.

21. A fastening means for a strap for a tagging device according to claim 20, wherein the latch plate is arranged such that moving the collar causes the contact to be broken and an alarm to be activated.

22. A combination of a strap and a fastening means for a tagging device, comprising:

a strap including electrical circuit means, the strap having a first free end and a second free end; and fastening means according to claim 13.

23. A combination of a strap and a fastening means according to claim 22, wherein the electrical circuit means comprises a flexible printed circuit board integrally molded within the strap.

24. A combination of a strap and a fastening means according to claim 22, further including means to adjust the length of the strap to suit a wide variety of user sizes.

25. A combination of a strap and fastening means for a tagging device according to claim 24, wherein the means to adjust the length of the strap comprises a plurality of holes on the second free end of the strap to correspond to a lug on the latch plate such that the lug engages with a hole at a position to provide a desired size of closed strap.

26. A tagging device comprising:

a housing having electronic circuitry enclosed therein; and a combination of a strap and fastening means according to claim 22.

27. A tagging device according to claim 26, wherein the electronic circuitry within the housing includes means for transmitting a signal to a location remote from the device.

* * * * *